US006407711B1

(12) United States Patent
Bonebright et al.

(10) Patent No.: US 6,407,711 B1
(45) Date of Patent: Jun. 18, 2002

(54) ANTENNA ARRAY APPARATUS WITH CONFORMAL MOUNTING STRUCTURE

(75) Inventors: Mark Bonebright, El Cajon; Bill McNaul, Ramona; Tony Rerecich; Jon Duff Weatherington, both of San Diego; Rodney Sinclair; John Wittmond, both of Thousand Oaks; William Zimmer, West Hills, all of CA (US)

(73) Assignees: Science and Applied Technology, Inc.; Composite Optics, Incorporated, both of San Diego, CA (US)

( * ) Notice: Subject to any disclaimer, the term of this patent is extended or adjusted under 35 U.S.C. 154(b) by 0 days.

(21) Appl. No.: 09/841,829

(22) Filed: Apr. 24, 2001

(51) Int. Cl.[7] ..... H01Q 1/28
(52) U.S. Cl. ..... 343/705; 343/878
(58) Field of Search ..... 343/705, 708, 343/700 MS, 853, 878, 906, 872

(56) References Cited

U.S. PATENT DOCUMENTS 3,699,547 A * 10/1972 O'Hara et al. ..... 343/705
4,816,836 A 3/1989 Lalezari ..... 343/700 MS
5,019,829 A * 5/1991 Heckman et al. .... 343/700 MS
6,191,750 B1 2/2001 Bonebright ..... 343/767
6,198,445 B1 * 3/2001 Alt et al. ..... 343/705
6,313,810 B1 * 11/2001 Andersson et al. ..... 343/872

* cited by examiner

*Primary Examiner*—Tan Ho
(74) *Attorney, Agent, or Firm*—Brooks & Fillbach; Michael Blaine Brooks; Andrew Steven Naglestad

(57) ABSTRACT

A carrier structure apparatus for mounting conformal antenna elements to a non-planar mounting surface as part of an antenna array of an airborne vehicle or ground-based system also comprising a seeker section, fairing and guidance processing system. The carrier structure is a rigid and conductive apparatus that is made to conform to the geometric configuration of both the antenna element as well as the mounting surface. The conformal antenna is rigidly mounted to the carrier structure, which is in turn removably affixed to the non-planar mounting surface. With the carrier structure, each antenna element of the array may be individually tested and replaced prior to and after installation in array.

24 Claims, 8 Drawing Sheets

ANTENNA ARRAY APPARATUS WITH CONFORMAL MOUNTING STRUCTURE

The U.S. Government has a paid-up license in this invention and the right in limited circumstances to require the patent owner to license others on reasonable terms as provided for by the terms of contract No. N00019-94-C-0078 awarded by U.S. Department of Defense (Navy).

FEDERALLY SPONSORED RESEARCH

The invention was made with Government support under N00019-94-C-0078 awarded by the Department of the Navy. The Government has certain rights in the invention.

FIELD AND BACKGROUND OF THE INVENTION

The present invention relates to an apparatus for mounting a RF antenna array to a non-planar surface. More particularly, the present invention relates to an apparatus for attaching a plurality of discrete antenna elements to a surface of curvature such that the antenna array is made to conform to the contour of a complex three-dimensional surface.

While the invention disclosed herein may be used in a wide variety of RF sensing applications in which discrete antenna elements are mounted in conformity to nonplanar mounting structures, the preferred embodiment is directed to the antenna elements of a RF sensing apparatus of an aircraft, sensor pod, missile or surface array having a substantially cylindrical or conical array configuration. The antenna array may be coupled to an Anti-Radiation Homing (ARH) subsystem, for example, and the RF sensing apparatus used to detect a target and track its position using signals received in the form of energy emitted by or reflected from the target. The RF sensing apparatus embodying the present invention includes a passive antenna array comprising a plurality of individual broadband antenna elements, each generating a voltage when excited by an electromagnetic waveform emanating from the target. The elements are connected to a broadband receiver where the signals are processed and the signal information passed to a guidance processing unit for performing various guidance functions. For example, the guidance processing unit may perform angle-of-arrival determinations in which the direction of the source of a signal within the array's field of view is located using signal information derived from the voltages sensed by the elements of the array.

A conventional RF sensing apparatus employs a plurality of RF antenna elements mounted on a stationary device or moving surface such as the nose of an aircraft, missile, sensor pod or other airborne apparatus. In more recent missile applications, the antenna elements have been confined to a structure aft of the nose section, which may house additional sensors. The antenna elements may then be distributed in one or more ring-like configurations protectively concealed below the skin of the cylindrically or conically shaped RF sensing apparatus. A low profile antenna array made compliant to its mounting surface while preserving the overall aerodynamic configuration of the airborne vehicle, or the surface continuity of the mounting surface, is generally referred to as a conformal antenna.

Positioning forward-looking conformal antenna elements behind a fairing, radome or similar protective and electromagnetically compatible mounting structure creates a formidable set of problems. First, the individual antenna elements, distributed circumferentially around the body of the RF sensing apparatus, are substantially shielded from signals originating on the opposing side of the RF sensing apparatus. Where the emitter signal is obliquely incident on the vehicle, the vehicle body shields as many as half the individual elements composing the array. This can significantly impair the performance of a direction-finding system using an array of conformal antenna elements. The antenna elements not shielded must then be capable of acquiring a minimum number of signals to generate independent phase and/or amplitude measurements at sufficiently high signal-to-noise ratios to resolve angular ambiguities and measure the angles-of-arrival accurately. The problem is further complicated by the polarization diversity of the antenna elements in the case of a cylindrical distribution of elements introduced in the preferred embodiment below. To this end, it is desirable to efficiently arrange a large number of compact elements in a dense array configuration.

As a second problem, the nose section of the RF sensing apparatus obstructs the antenna elements aft of it from signals originating from the direction immediately in front of the nose. The conformal nature of the element therefore conflicts with the preference for an end-firing antenna array. The challenge is then to design an array having a large effective field of view that is sensitive to both off-axis signals originating from the broadside of the RF sensing apparatus, as well as signals propagating along the vehicle's centerline axis. Maintaining this degree of sensitivity across the field of view is achieved in part by mounting the antenna elements as close as practically possible to the surface of the RF sensing apparatus.

Ideally, an antenna element of a RF sensing apparatus is of high gain and provides reliable and uniform electrical performance over a wide range of frequencies. There are many such broadband antennas, including the spiral, log-periodic and traveling wave antennas, but few can be made small enough to satisfy the particular criteria necessary for missile and compact sensor suite applications. The antenna elements must lend themselves to being mounted in non-planar configurations and in sufficient number and density to acquire the signals necessary for performing direction-finding without producing significant electrical coupling between adjacent antenna elements. At the same time, an antenna element for missile ARH subsystems and other rugged, portable applications more generally, must be designed to withstand a range of demanding environmental conditions including severe shock, vibration, humidity, pressure and temperature variations.

One example of a suitable conformal antenna element is the microstrip antenna manufactured with printed-circuit technology. A typical microstrip antenna comprises a metal radiator and a ground plane separated by a dielectric layer with a thickness on the order of a tenth of a wavelength. The microstrip is then fed by a transmission line feed. While these microstrip antennas are small in volume and afford great variation in the number of elements and the array configuration, the manner of mounting or conforming the microstrip antennas to non-planar surfaces poses a challenge.

One fabrication technique for applying a microstrip antenna to a substantially curved surface involves constructing an antenna assembly from a sheet of dielectric material, then deforming the assembly to conform to the curved surface. The method as described is unsuitable for complex, curved surfaces, particularly those subject to stressing environments, because the various layers of the microstrip are under differing levels of tension/compression and are thus predisposed to delamination.

In a second method described in U.S. Pat. No. 4,816,836 to Lalezari, the fabrication of the microstrip is achieved in a two-step process in which a thicker first layer of dielectric is made to adhere to the curved surface and a second thinner layer of dielectric including the antenna circuit is shaped and secured to the first layer. Not only can the antenna element suffer from delamination, but the resulting antenna element possesses a substantially curved forward profile that gives rise to unacceptably large variations in the polarization orientation across the face of the antenna. This antenna as well as the previously described antenna and method of construction are therefore less desirable for use in stressful airborne vehicle applications.

In addition to the manufacture and installation of the individual antenna elements, a challenge remained to develop a RF sensing apparatus that exhibits the geometric and electrical uniformity necessary for implementing high-quality direction-finding. One prior art method of constructing a ring-shaped conformal array for mounting within the confines of a recessed channel in a missile system involves a three-step process. In the first step, the antenna elements with electrical connectors are pre-assembled in the shape of a ring. In the second step, the antenna elements are embedded in a compliant material such as epoxy in the shape of a ring that is severed at one point in the circumference. In the third step, the ring is expanded and the entire epoxy-embedded array slipped into the recessed channel of the RF sensing apparatus and then mounted.

This prior art assembly presents two problems. First, the array, having been embedded in epoxy, prevents individual elements from being replaced or repaired. As a wasteful and expensive result, the entire array must be discarded if any one element fails or an electrical connection is open or otherwise substandard. Second, a geometric error is introduced in the assembly of the array that perturbs the electrical uniformity of the array. The inner diameter of the ring is only slightly smaller than the outer diameter of the portion of the RF sensing apparatus to which it is mounted. After installation, the resulting gap created between the ends of the ring that nearly, but not entirely, meet is subsequently filled. The gap creates an electrical discontinuity which, if not properly cured, may give rise to variations in the phase and magnitude of signal reception by the antenna elements in proximity to the heterogeneity; such variations making the array unsuitable for direction-finding applications.

Below is described a novel apparatus for promoting the manufacturability, reliability, testability and uniformity of a conformal array for mounting antenna elements to non-planar surfaces.

SUMMARY OF THE INVENTION

It is an object of the present invention to provide an efficient, cost-effective means of manufacturing and assembling a conformal antenna array comprising a plurality of individual antenna elements, the elements being used for either reception or transmission of signals.

It is another object of this invention to provide a modular design which affords an opportunity to (1) individually test antenna elements prior to their installation in an antenna array and (2) test the antenna array as a whole prior to permanently and inalterably seating the antenna elements of the array.

It is another object of the present invention to create a conformal antenna array comprising antenna elements and optional calibration elements with the geometric symmetry necessary to achieve electrical uniformity among a plurality of antenna elements for accurately performing direction-finding.

The conformal antenna array of the present application comprises a plurality of broadband, conformal antenna elements. The antenna elements described are for the reception of incoming signals for a ARH subsystem but may be used for both receiving and transmitting RF signals in any number of antennas arrays, radar systems or platforms including aircraft, missiles, sensor pods or surface arrays. The antenna elements may be arranged in a non-planar configuration including one or more ring-like structures in a plane transverse to the principal axis of a cylindrically or conically shaped RF sensing apparatus. As described in the preferred embodiment, the antenna elements sense incoming signals that are processed by a receiver and guidance processing unit (of a radar or continuous wave system). The antenna elements may alternatively be used to transmit signals generated by a signal generator in a ground-based or airborne radar system. The signals sensed by a receive antenna element or generated for a transmit antenna element are conveyed by means of an electrical connection that is detachably connected to the corresponding signal processing or transmitting hardware.

The antenna array may further include calibration antennas which, when stimulated, induce voltages in the receive elements; the voltages being conveyed by means of a switching network to a multi-channel receiver for processing the signals and extracting direction-finding information.

Each receive element is indirectly mounted to a RF sensing apparatus, such as a missile seeker section, by means of a "carrier structure." A carrier structure is a rigid and conductive platform that is in mechanical and electrical contact with an individual receive element by means of a substantially permanent bond. The carrier structure serves as both a support structure and a ground plane to the corresponding antenna element. An individual receive element, in cooperation with the attached carrier structure, may be individually evaluated prior to installation on the seeker section or other mounting surface. After installation on the seeker section or other mounting surface, the plurality of receive elements composing the array may be collectively tested and any substandard units may be repaired or replaced individually.

The seeker section in the preferred embodiment has a substantially cylindrical or conical channel, groove or indentation machined around its circumference in the plane transverse to the principal axis of the aircraft, missile or sensor pod. Each carrier structure has an inner surface that substantially conforms to the seeker section channel or groove where they mate. Each carrier structure, in combination with an individual receive element, is secured to the non-planar surface of the seeker housing in a manner that is rigid but necessarily removable.

The carrier structure has an upper surface comprising a forward surface and a rear surface. The upper surface is directed toward the exterior of the aircraft, missile, sensor pod or other sensor housing, and the forward surface is an impedance matching section corresponding to the end of the RF sensing apparatus in the primary direction of signal propagation. The rear surface is made to conform to the contours of the base of a receive element where the carrier structure and receive element are joined. The receive element contemplated in the preferred embodiment is a broadband, horn antenna having a substantially planar surface where it mates with the carrier structure. The carrier structure and receive element are bonded by means that is rigid, permanent and conductive.

In the preferred embodiment, where forward is the direction toward the main beam, the forward portion of the upper surface of the carrier structure possesses a substantially uniform curvature between the forward end of the receive element and the edge of the carrier structure where it mates with the mounting structure. This forward portion is for impedance matching, and is the shape of a ramp to provide a smooth, continuous surface for conducting electromagnetic waveforms originating from the forward direction of the aircraft, missile, sensor pod or other sensing apparatus that propagate toward the conformally mounted receive element.

The carrier structure is made of a conductive material, and optionally includes support for removably mountable calibration elements. In the preferred embodiment, the calibration elements are affixed to two adjacent carrier structures such that the calibration element is equidistant from the two receive elements, thereby coupling RF energy into the elements with substantially the same amplitude and phase delay. A uniform electrical potential is maintained between any given receive element and the two adjacent calibration units. The calibration units are made to mount directly to the carrier structures instead of the seeker section to promote the integrity of the electrical continuity between the calibration and receive elements of the entire antenna array.

The principal benefit of the present carrier structure invention is twofold. First, the permanency of the bond between the carrier structure and the receive elements promotes the manufacture and testing of the individual receive elements and the array as a whole. Second, the detachability of the connection between the carrier structure and the seeker housing permits substitution of any individual receive element where necessary.

Although the carrier structure increases the overall parts count of the antenna array, an appreciable savings in the cost of manufacture is realized by obviating the need to discard the entire array apparatus due to an individual faulty component.

While the carrier structure also consumes a portion of the scarce volume in missile applications, the benefits afforded by the mechanical and electrical reliability of the antenna array work to offset the volumetric cost created by the inclusion of the carrier structures.

DETAILED DESCRIPTION OF THE PREFERRED EMBODIMENT

Figure 1:
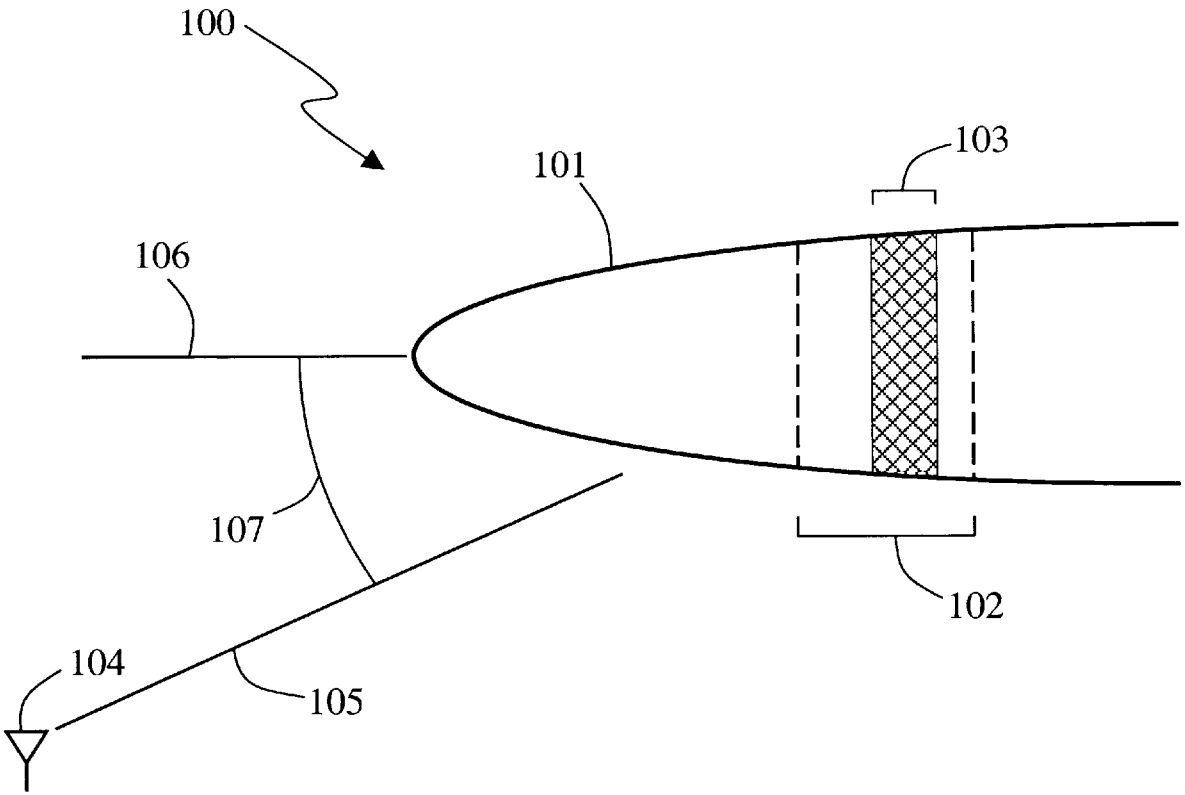
FIG. 1 is a missile or comparable conformal array system with a seeker section comprising an antenna array.

FIG. 1 illustrates the forward most end of a missile system or sensor pod representative of the type used for purposes of the present invention. The missile is an example of a complex conformal mounting surface found in both airborne vehicle and ground-based antenna systems in which the present invention would have application. The missile 100 is launched or suspended from an aircraft or equivalent apparatus, and is responsive to electromagnetic signals emanating from an emitter 104. The nose structure 101 of the missile 100 comprises a radome and the underlying data acquisition and signal processing systems. The data acquisition system may include one or more guidance processing units for target identification or tracking purposes.

Also included in the nose structure 101 is the seeker section 102 which includes a conformal antenna array 103 comprising a plurality of RF receive elements. The conformal array 103 is sensitive to impinging broadband signals from which information is extracted about the identity and direction of the source of the signal. The direction of an emitter 104 is indicated by the line-of-sight vector 105 that forms an angle 107, $\theta$, with the principal axis 106 of the missile 100. The line-of-sight 105 falls within the conformal antenna array's 103 field of view, which has the shape of a right circular cone centered about the principal axis 106.

The location of the seeker section 102 with respect to the nose structure 101 imposes significant constraints on the design and performance of the antenna array 103. The antenna array 103 must conform to the external contours of the missile 100 while maintaining maximum sensitivity to received RF radiation over the entire field-of-view. When the received signal impinges on the missile 100 at small angles of incidence, i.e., small angle 107, or $\theta \approx 0$, the detected signal is attenuated because the conformal antenna array 103 is physically shielded by the nose structure 101 and the seeker section 102 as well as the antenna array 103 itself. When the impinging signal is incident at a large angle 107, $\theta \approx \pi/2$ in the present application, the seeker section 102 as well as the antenna array 103 obstructs the sensing of the signal by the portion of the array 103 on the opposing side of the missile 100. The severity of the degradation due to these phenomena is reduced by the present apparatus, which permits the antenna elements to be densely packed in close proximity to an external surface to which the antenna elements must conform.

Figure 2:
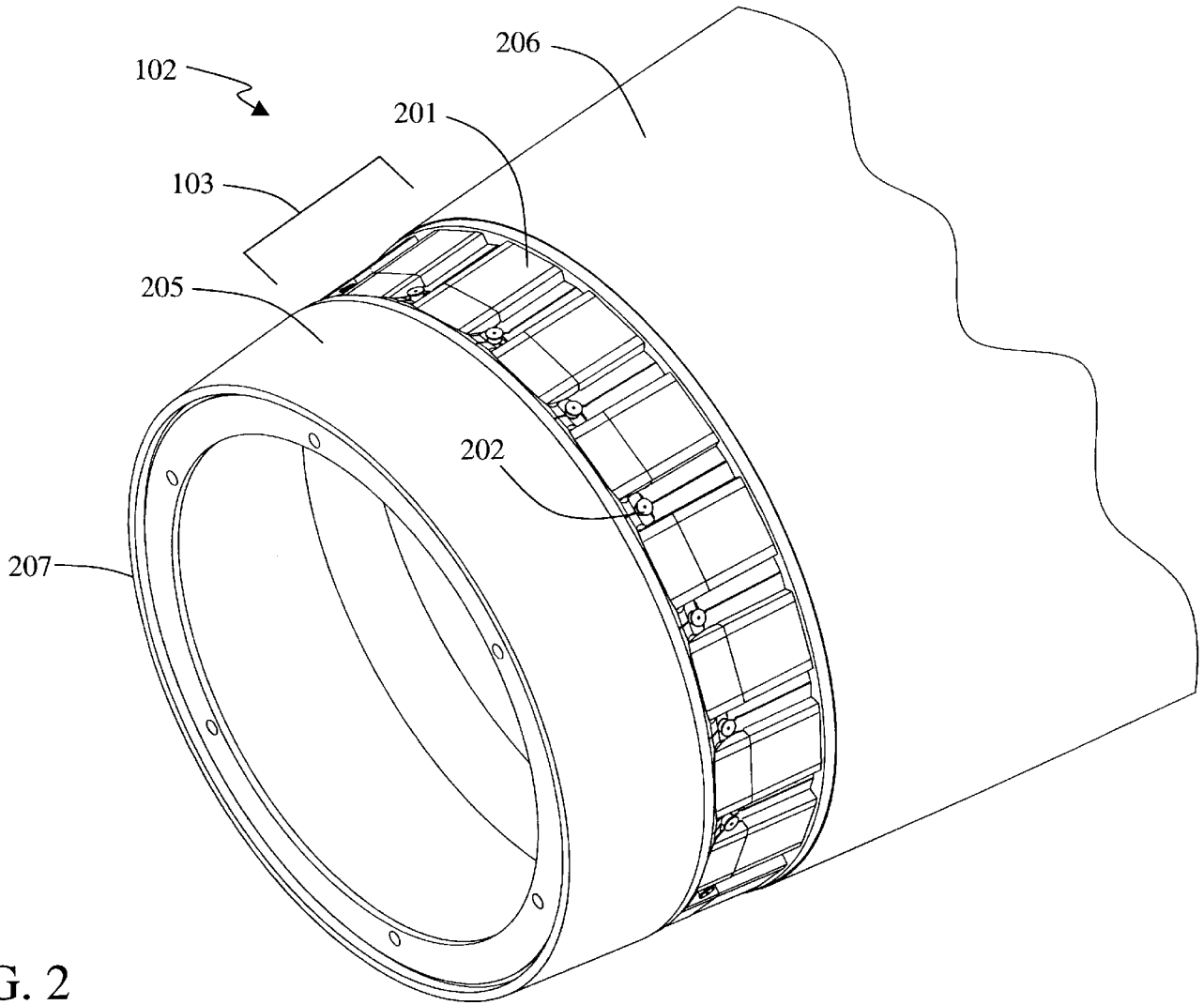
FIG. 2 is a perspective drawing of the seeker section illustrating the interdigitated relationship between the conformally mounted receive units and the calibration units as mounted in the recessed channel of the seeker section.

Illustrated in FIG. 2 is the seeker section 102 including the seeker housing 207 which has mounted to it the plurality of individual receive units 201 and calibration elements 202 that compose the array 103. The plurality of receive units 201 may be connected to a switching network (not shown) which is in turn connected to a multi-channel receiver (not shown) and guidance processor (not shown) for acquiring the phase and/or amplitude measurements used for performing interferometric or correlation based direction-finding. The seeker housing 207 is made of a rigid and machinable material, such as stainless steel. The seeker housing 207 serves as a chassis for both the array 103 mounted to its exterior as well as the avionics embedded in the interior. Skin surfaces 205 and 206 constitute the external surfaces of the seeker section 102, and are separated by a channel or a groove in which the receive units 201 and calibration elements 202 are mounted. In the final assembly, the channel of the seeker housing 207 is covered with a fairing (illustrated in FIG. 7 below) that joins the skin surfaces 205 and 206 to form a smooth and continuous tapered conical surface, right cylinder or other complex shape. The width and depth of channel are preferably uniform around the entire circumference of the seeker housing 207, and sufficiently large to enclose the plurality of receive units 201 and calibration elements 202, the details of construction to be explained below.

Figure 3:
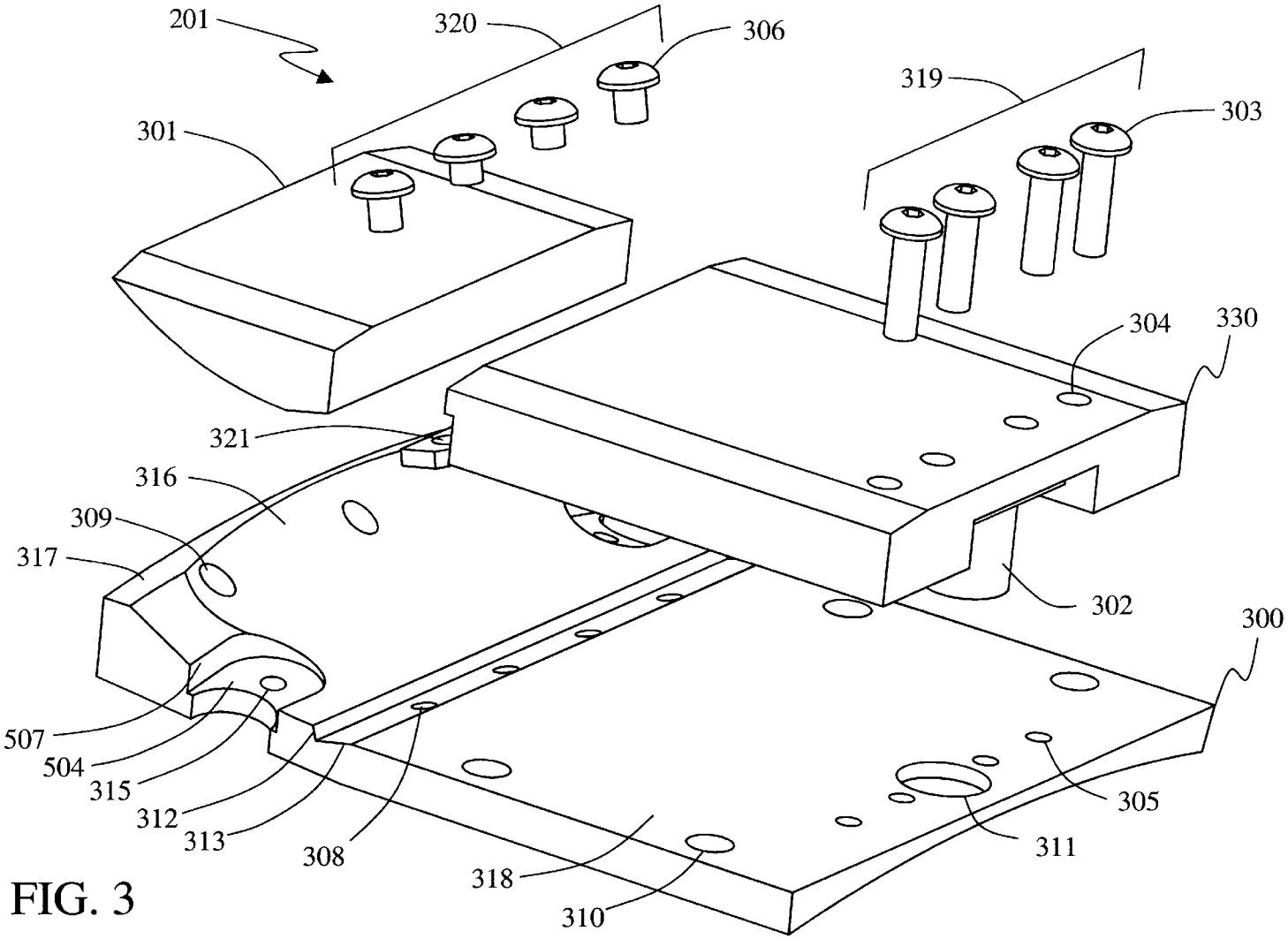
FIG. 3 is an exploded view of a receive unit comprising a receive element, dielectric wedge and carrier structure.

Illustrated in FIG. 3 is an exploded view of a receive unit 201 comprising a receive element 330, carrier structure 300 and dielectric wedge 301. The carrier structure 300 is a rigid, conductive support on which the receive element 330 is rigidly and permanently affixed using bonding means, preferably including a combination of bolts 303 and 306 or the equivalent and bonding agent. In the preferred embodiment, the carrier structure 300 has an upper surface that faces approximately radially outward from the seeker section 102, the upper surface comprising a matching section 316 as well as a rear surface 318. The orientation of matching section 316 is defined along the direction of the main beam of the receive element 330. The rear surface 318 is of sufficient width and length to accommodate the receive element 330, and substantially planar where they mate in order to minimize the variation in the polarization orientation across the width of the receive element 330.

The receive element 330 is responsive to broadband signals originating from the forward direction of the array 103 as well as signals impinging transversely. The receive element 330 of the preferred embodiment is a "dielectric sheet horn" antenna similar to the element disclosed in U.S. Pat. No. 6,191,750 to Bonebright. It was selected as the receive element for its superior broadband gain characteristics, but other receive elements may be suitable depending on the particular requirements of the application. The receive element 330 is in electrical communication with the carrier structure 300, as well as a signal distribution network such as a switching network (not shown) by means of the electrical connector 302 passing though the carrier structure 300.

Also included is a dielectric wedge 301, which is made to substantially conform to both the receive element 330 and the carrier structure 300 when brought into contact. The purpose of the dielectric wedge 301 is to electromagnetically couple the receive element 330 to the exterior surface of the seeker section 102. The dielectric wedge is preferably made of a dielectric material having a loss tangent as low as practicably possible.

As a first step in the assembly of the receive unit 201, an individual receive element 330 is permanently and non-detachably affixed to the rear surface 318 of the carrier structure 300. A bonding agent or adhesive is applied to the mating surface and the receive element 330 pressed into place by means of a first row of bolts 319 and a second row of bolts 320. Note that the bonding agent may be of a dielectric material or electrically-conductive material to facilitate electrical communication between the receive element 330 and the carrier structure 300. The bolts 319 pass through the holes 304 of the receive element 330 as well as the mounting flange of the electrical connector 302, and into to the threaded holes 305 of carrier structure 300.

The connector 302 is a detachable connector such as a coaxial connector or plug connector depending on whether the electrical signal is communicated to the multi-channel receiver and processor via a coaxial cable, waveguide, stripline or twisted pair. In the present application, the connector 302 extends below receive unit 201 and into the cavity 311 when the receive element 330 is brought to bear on the carrier structure 300. The receive element 330 is affixed to the carrier structure 300 by means of threaded bolts 306 that pass through the holes 321 of the conductive leading edge 601 (referring ahead to FIG. 6) of the receive element 330 and engage the threaded holes 308. The threaded holes 308 are featured in the notch, defined by the facets 312 and 313, that runs laterally across the carrier structure 300. The number and location of the bolts 303 and 306 must necessarily be tailored to suit the particular antenna element implemented.

The wedge 301 is made of a substantially electromagnetically transparent material having a dielectric material with a loss tangent as low as practicable. The wedge 301 is bonded to the receive element 330 and carrier structure 300 using adhesive. When working in cooperation, the carrier structure 300, receive element 330 and wedge 301 form an integral broadband, high gain, antenna capable of being individually tested prior to installation in the seeker housing 207 and assembly of the conformal antenna array 103. Each of the receive units 201 may then be evaluated for its individual quality and uniformity and thereby undesirable elements may be culled. In the preferred embodiment, there are three or more receive units 201 uniformly distributed about the seeker section 102, which, when working in cooperation, are capable of acquiring the RF signals necessary to make angle-of-arrival determinations.

Figure 4:
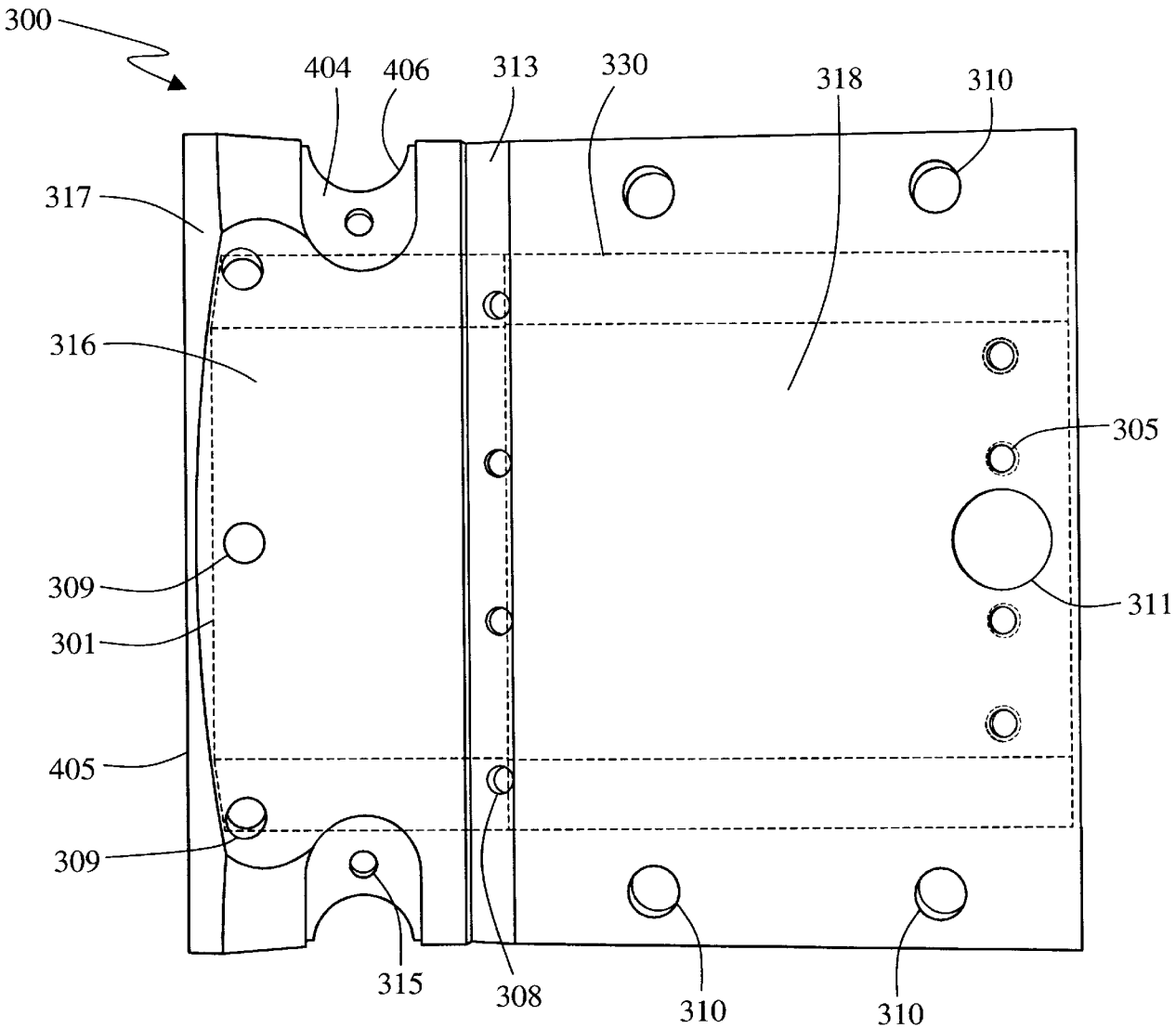
FIG. 4 is a top-down view of the upper surface of a carrier structure illustrating the positional relationship of the receive element and dielectric wedge relative to the carrier structure.

Illustrated in FIG. 4 is a view of the carrier structure 300 normal to the upper surface 318. The leading surface 405 constitutes the anterior face of the carrier structure 300, and is mounted toward the forward direction of the missile 100 or the front direction of the array. Dielectric wedge 301 and receive element 330 (illustrated by dashed line) are tangentially centered (the vertical direction of FIG. 4) about the carrier structure 300. Thread holes 308 of the facet 313 engage the bolts 320 (of FIG. 3), which are applied to bring receive element 330 in physical and electrical communication with the carrier 300. The carrier structure 300 then functions as a ground plane and terminates any undesirable electromagnetic fields at the fringe of the receive element 330. The forward holes 309 and side holes 310 are threaded and are engaged by bolts 701 and 802 (see FIGS. 7 and 8), respectively, from the interior of the seeker housing 207. The receive unit 201 is then removably affixed to the seeker housing 207, permitting the entire receive unit 201 to be removed from the conformal array 103 and replaced if need be.

The mounting surface 404, in combination with the mounting surface 404 of an adjacent carrier structure, provides a uniform planar surface or facet for removably affixing a calibration unit 202, the details of which are provided below. The radially curved surface 406 on the other hand, is intended to accommodate a calibration element 202 and/or a coaxial cable (not shown) that brings the calibration element 202 in electrical communication with a signal generator (not shown) accessible through the interior of the seeker housing 207. In the final assembly, the calibration units 202 are mounted symmetrically on either side of the receive unit 201 in order to uniformly irradiate the corresponding receive elements 330.

Figure 5:
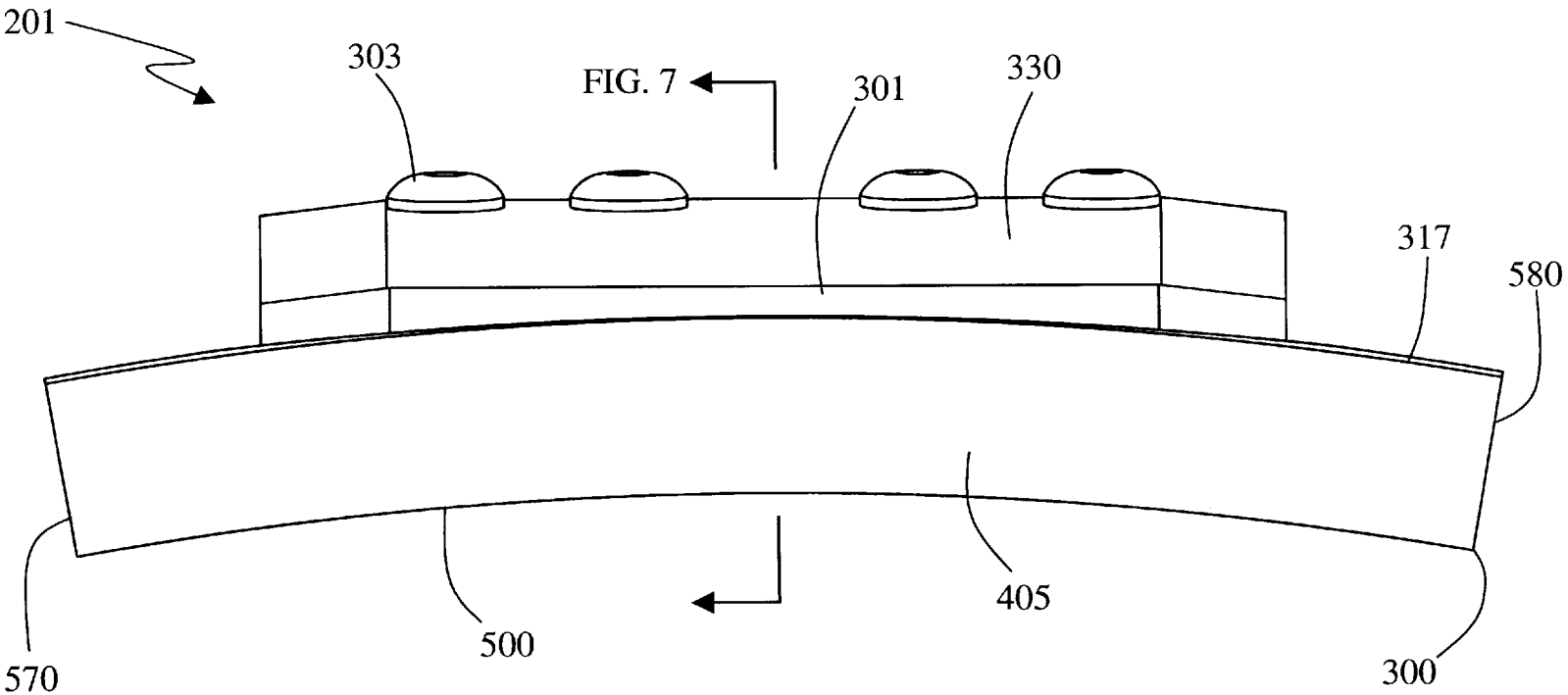
FIG. 5 is a frontal view of the carrier structure illustrating the curvature of the leading face of the carrier structure where it mates with the seeker section.

Illustrated in FIG. 5 is a frontal view of the receive unit 201 as seen from a vantage that is substantially normal to the leading surface 405. The leading surface 405 and the inner surface 500 of the carrier structure 300 are made to mate with the corresponding surfaces of the channel of the seeker housing 207 in which the conformal array 103 resides. In the preferred embodiment, the inner surface 500 and surface 317 each subtend a portion of a substantially cylindrical or conical shape that is concentric about to the principal axis 106. The receive element 330 is in turn symmetrically affixed to the carrier structure 300; there being an equal distance between the receive element 330 and each of the side edge surfaces 570 and 580.

Figure 6:
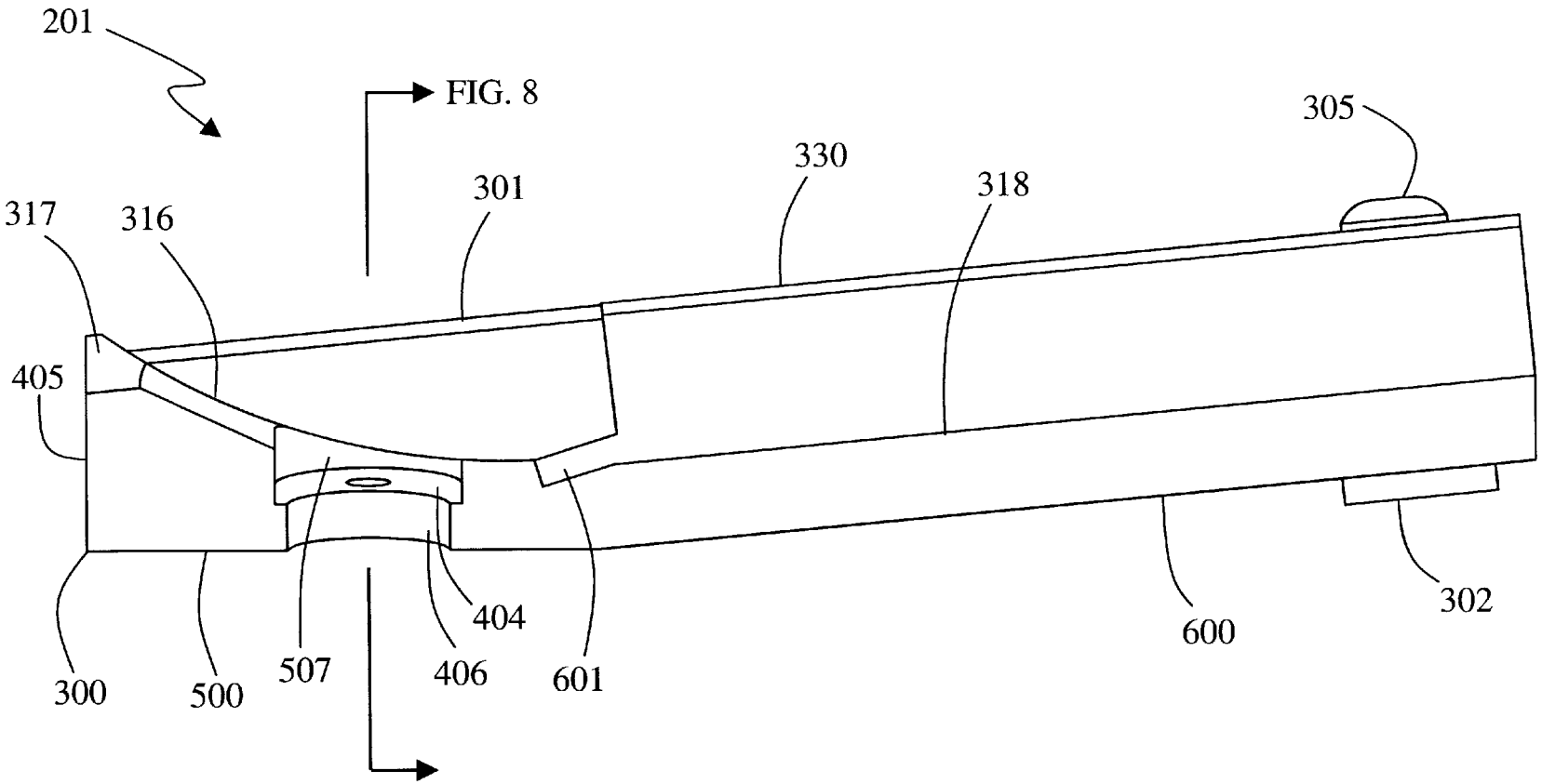
FIG. 6 is a longitudinal side view of a receive unit illustrating the relationship of the receive element and dielectric wedge to the corresponding carrier structure.

Illustrated in FIG. 6 is a longitudinal side view of a receive unit 201, the unit 201 comprising a carrier structure 300, receive element 330 and wedge 301. Although other optimized configurations may be more suitable, the matching section 316 of the upper surface of the carrier structure 300 has a surface of substantially uniform curvature between the base of the receive element 330 and the edge where the matching section 316 intersects the surface 317. Preferably, the radius of curvature of surface of the matching section 316 is approximately equal to a quarter or a third of a wavelength at the lowest frequency of interest. The calibration unit 202 is located at a position anterior to the receive element 330, such that the receive element 330 may be receptive of any calibration signal emitted.

The rear surface 318 of the carrier structure 300 is made to conform to receive unit 201 where they mate. Surface 318 is substantially planar in two dimensions in complement to the receive element 330. The receive element 330 is made substantially planar to maintain a constant polarization orientation across the width of the receive element 330.

The substantially planar relationship between the carrier structure 300 and the receive element 330 avoids the use of the prior art methods of antenna manufacture described above. The conformal antennas in each of those cases are particularly undesirable in the present application because they would, if applied here, result in receive antennas that have polarization orientations that vary in the transverse plane across the width of the element.

Although the substantially planar surface for mounting the receive element 330 could be machined directly into the conical or circular contour of the seeker housing 207, the use of a plurality of carrier structures affords several notable advantages. First, manufacturing the carrier structure 300 with the contour of the receive element obviates the expense of machining such surfaces into the seeker housing 207 directly. The channel of the seeker housing 207 may instead be turned on a lathe with relative ease, and is more cost-effective than machining the planar surface of each of the receive units 201 into the channel of the seeker housing 207.

Second, the use of the carrier structure 300 permits fine adjustments to be made in the positions of the receive elements 330 and the calibration elements 202, resulting in increased electrical uniformity and consistency between the receive elements 330 and better performance from the conformal array 103 more generally.

Third, the surface 318 may be tailored to accommodate the geometric specifications of a wide variety of receive elements. The receive element 330 may therefore assume more complex nonplanar configurations without incurring the expense of machining the seeker housing 207 directly.

The regions where the carrier structure 300 meets the seeker housing 207 can be defined by the inner surfaces 500 and 600, both of which are substantially cylindrical or conical about the principal axis 106. The character of these surfaces is such that they bring each receive unit 201 into substantial physical and electrical conformity with the seeker housing 207.

Figure 7:
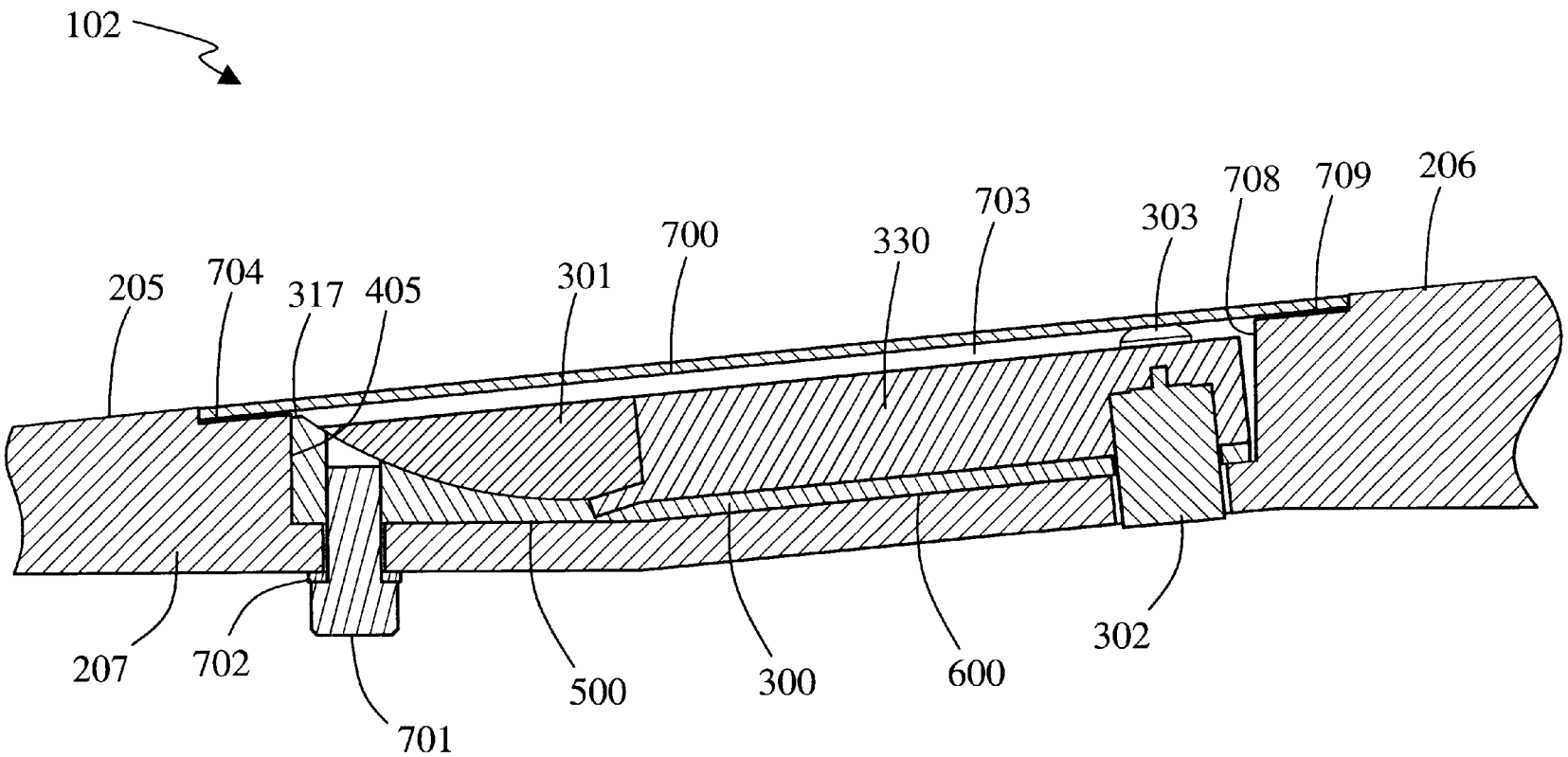
FIG. 7 is a longitudinal cross-section through the center of a receive unit illustrating the conformal mounting of the receive element using the carrier structure of the present invention.

Illustrated in FIG. 7 is a longitudinal cross section of the seeker section 102 where it bisects the carrier structure 300, as indicated by the section line of FIG. 5. The receive unit 201 resides within a recessed channel in the seeker housing 207. The receive units 201 are then shielded in the final stages of assembly by the fairing 700. The fairing 700 lies in the recessed rims 704 and 709, and provides a smooth and continuous external surface joining skin surfaces 205 and 206. The carrier structure 300 is designed such that the receive element 330 is physically located as close as practically attainable to the fairing 700 while maintaining the proper attitude between the receive element 330 and the principal axis 106 of the missile 100. The radius of curvature of the inner surfaces 500 and 600 where they mate with the seeker housing 207 also varies along the length of the missile 100, permitting the receive element 201 to occupy as little of the interior space of the seeker section 102 as practically possible.

Also of concern is the thickness of the carrier structure 300, which is preferably only as thick (i.e., depth measured in the radial direction of the missile 100 or other housing) as necessary to provide structural integrity, thereby occupying minimal space in the interior of the seeker section 102.

One aspect of the point of novelty of the present invention pertains to the removable attachment of the receive unit 201, and the carrier structure 300 particularly, to the seeker housing 207. The surfaces 500 and 600 (illustrated in FIG. 6) of the carrier 300 are removably affixed to the seeker housing 207 by means of threaded bolts 701 that engage the threaded holes 309 (illustrated in FIG. 3). One skilled in the art will recognize that other equivalent means are available to removably attach the carrier structure 300. Because of the detachable nature of the receive unit 201, the receive element 330 may be tested preceding and subsequent to its installation in the seeker housing 207. Thereafter, if necessary, the entire receive unit 201 may be removed and replaced without any damage to the seeker section 102.

Without a removable carrier structure, the receive element would necessarily be affixed directly to the seeker section. This would entail machining the seeker housing to conform to the receive element, which is generally more expensive than machining the carrier structures individually. Second, performance testing of the array would necessarily entail mounting one or more receive elements in the seeker housing, which may involve the bonding of the element to the seeker, thus impairing the prospect of replacing any antenna element.

The present invention therefore affords the convenience of substituting inferior elements prior to final assembly, as well as reducing the possibility of waste due to defective antenna elements.

An important consideration in the implementation of the carrier structure 300 pertains to the leading surface 405 (referring back to FIG. 6) of the carrier structure, which must accurately mate with the corresponding face of the channel in the seeker housing 207. The boundary between the two surfaces is in proximity of the main lobe of the receive element 201 and presents an electromagnetic discontinuity to impinging radiation. The surface 405 and the seeker housing 207 must be in substantial conformity at the boundary with a very minimal gap. Preliminary tests with the preferred embodiment indicate that a tolerance of 2 mils to be sufficient to avoid impairing the performance of the conformal array 103.

The rims 704 and 709 are made to retain the fairing 700 in such a way as to provide a substantially smooth and continuous external surface joining surface 205 to 206. In the preferred embodiment, the surface 317 of the carrier structure 300 illustrated in FIG. 3 is made to transition, in a substantially flush manner, with the surface 704 of the seeker housing 207 where the carrier structure 300 terminates near the leading edge of the fairing 700.

The fairing 700 in the preferred embodiment is a quartz material or other substance that is substantially transparent to electromagnetic radiation across the bandwidth of interest. The fairing in the preferred embodiment is approximately 15 mils thick to provide enough elasticity and flexibility to slide over the seeker housing 207 and snap into the rim 704.

After the installation of the fairing 700, a potting material (not shown) having as low a loss tangent as reasonably possible is injected into the void 703. A syntactic material is particularly suited to this application. A syntactic material is a material such as resin in which the effective dielectric constant is artificially reduced by the inclusion of microbubbles. The potting material then displaces the air in the cavity, thus preventing the components of the array 103 from the degrading effects of pressure differentials and water ingress. The potting also serves to promote the structural integrity of the conformal array 103 by rigidly encapsulating the various components.

Also illustrated in FIG. 7 is a RF connector 302, such as a coaxial connector, that may be attached and removed from the corresponding connector of the feed. The receive element may then be evaluated prior to installation using a dedicated receiver and after installation by bringing the connector 302 of the receive element 201 in electrical communication with the corresponding connection of the element selection network (not shown). In the preferred embodiment, the electrical connector 302 protrudes through the cavity 311 in the seeker housing 207, affording access to the electrical connector 302 from the inside surface of seeker housing 207. The connector 302 may be connected to a receiver system (not shown) mounted within the interior of the missile 100.

Figure 8:
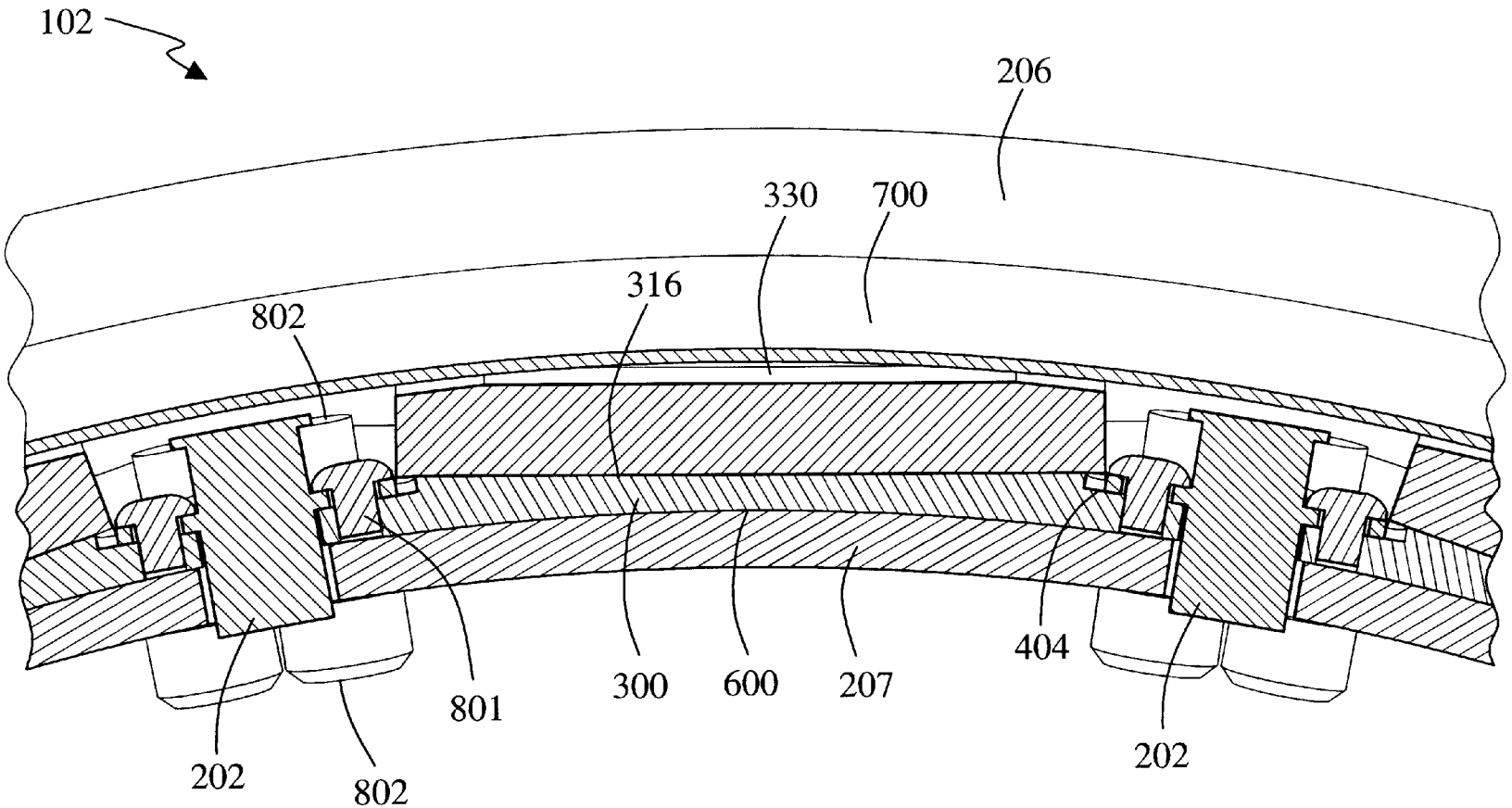
FIG. 8 is a transverse cross-section through a receive unit illustrating the conformal mounting of the receive element using the carrier structure of the present invention.

Illustrated in FIG. 8 is a transverse cross section of the seeker section 102 and the carrier structure 300 indicated by the section line of FIG. 6. The receive unit 201 is removably mounted, in part, by the bolts 802 that engage the holes 310 of the carrier structure 300. This particular section also illustrates the relative position of the calibration units 202, which are interleaved between adjacent receive units 201. The calibration elements 202 of the preferred embodiment are electrically-small, broad-beam antennas for the purpose of emitting waveforms of a predetermined frequency and amplitude necessary to calibrate the various receive elements of the array 103 in flight operation prior to performing interferometry.

Each calibration unit 202 mounts directly to the carrier structures 300 of two adjacent receive units 201. The surface 404 (also illustrated in FIG. 4) of two adjacent carriers creates a continuous planar surface upon which the calibration units are removably affixed by means of threaded bolts 801 that engage the threaded holes 315 illustrated in FIG. 4. The calibration elements 202 are mounted to the carrier structures 300, as opposed to the seeker housing 207, to reduce the risk of electrical discontinuity with the receive unit 201. This method of construction minimizes the number of electrical interfaces, and therefore promotes the electrical integrity and reliability of the final assembly of the conformal array 103.

Each calibration element 202 is in electrical communication with a signal generator (not shown) and grounded by means of the connection with the carrier structure 300. As with the receive element 330, the calibration unit 202 also includes a removable connector means for providing a detachable connection with its signal source.

The calibration unit 202 emits a signal whose amplitude and phase are measured at the two receive units directly adjacent to the calibration unit. The calibration signal strengths measured by the receive elements 330 are compared in order to determine the calibration factors for weighting received signals. The phase may be used to compensate for cumulative errors that arise in the determination of the phase difference between adjacent and non-adjacent receive elements 330.

The reliability of the calibration procedure depends on the ability of a given calibration unit 202 to uniformly illuminate the corresponding receive elements 330. This is achieved by precisely centering the calibration unit 202 between adjacent receive elements 330. The distances between a calibration unit and the associable receive elements must be substantially uniform over the entire array 103.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

We claim:

1. An antenna apparatus having a signal distribution network, the apparatus comprising:

a. a mounting structure having an exterior skin and a recessed channel;

b. a plurality of conformal antenna units detachably affixed to the mounting structure at the recessed channel; each conformal antenna unit comprising:

(1) an antenna element having a top surface and an opposing base;

(2) an antenna electrical connecting means in electrical communication with the antenna element; the antenna electrical connecting means being removably attachable with the signal distribution network;

(3) a carrier structure, of minimal thickness, comprising an upper surface and lower surface; the upper surface of the carrier structure being permanently affixed to the base of the antenna element, and the lower surface being detachably affixed to the recessed channel of the mounting structure;

c. a fairing for enclosing the recessed channel; the fairing being substantially flush with the exterior skin of the mounting structure; and d. dielectric potting of low loss tangent for encapsulating the conformal antenna units within the fairing;

whereby the top surface of each antenna element substantially conforms to the exterior skin of the mounting structure.

2. The antenna apparatus of claim 1, wherein the upper surface of the carrier structure has a matching section that is of substantially uniform curvature and continuous between the base of the antenna element and the exterior skin of the mounting structure.

3. The antenna apparatus of claim 2, wherein the antenna element is a broadband, directional antenna characterizable by a main beam and a bandwidth.

4. The antenna apparatus of claim 3, wherein the signal distribution network is further connected to a multi-channel receiver system.

5. The antenna apparatus of claim 4, wherein the mounting structure is substantially conical and characterized by a principal axis; the recessed channel circumscribing the conical mounting structure in a plane transverse to the principal axis of the mounting structure; the recessed channel having a depth minimally sufficient to accommodate the conformal antenna unit.

6. The antenna apparatus of claim 5, wherein the conformal antenna units are mounted around the circumference of the recessed channel of the mounting structure with substantially uniform unit-to-unit separation.

7. The antenna apparatus of claim 6, wherein the plurality of carrier structures are brought into substantial conformity with the recessed channel of the mounting structure in the direction of the main beam of the antenna elements such that a gap between the carrier structures and the mounting structure is less than two mils.

8. The antenna apparatus of claim 7, wherein the dielectric potting is a syntactic material.

9. The antenna apparatus of claim 8, wherein the antenna apparatus further comprises a plurality of calibration units, each calibration unit being removably affixed to two adjacent carrier structures such that the calibration unit is symmetrically disposed between two adjacent antenna elements.

10. A conformal antenna apparatus having a signal distribution network, the antenna apparatus comprising:

a. a mounting structure having a substantially non-planar surface;

b. a plurality of conformal antenna elements, each antenna element having a top surface and a bottom surface; the antenna element having a characteristic main beam;

c. a plurality of carrier structures of a conductive material; each carrier structure having an upper surface and a lower surface, the upper surface of the carrier structure having a forward portion and a rear portion; the lower surface of each carrier structure being substantially conformal to the mounting structure;

d. bonding means for permanently affixing the bottom surface of the antenna elements to the rear portion of the carrier structures;

e. fastening means for detachably anchoring the carrier structures to the mounting structure;

f. electrical connecting means for bringing the antenna elements in detachable electrical communication with the signal distribution network;

g. a fairing structure attached to the mounting structure for enclosing the antenna elements; and h. a dielectric potting for encapsulating the antenna elements within the fairing structure after being affixed to the mounting structure.

11. The antenna apparatus of claim 10, wherein the signal distribution network is further connected to a multi-channel receiver system characterized by a bandwidth.

12. The antenna apparatus of claim 11, wherein the antenna elements are uniformly mounted in one or more ring-like configurations in conformity with the mounting structure.

13. The antenna apparatus of claim 12, wherein the rear portion of the carrier structure is substantially planar at the junction where the antenna element is permanently affixed to the carrier structure.

14. The antenna apparatus of claim 13, wherein the forward portion of the carrier structure has a substantially uniform radius, in a coronal plane of an airborne vehicle, between the mounting structure and the bottom surface of the antenna element when detachably anchored to the carrier structure; the uniform radius being substantially equal to or greater than a quarter wavelength of a frequency of the bandwidth associated with the receiver system that is lowest.

15. The antenna apparatus of claim 14, wherein the upper surface of the carrier structure in the direction of the main beam is in substantial conformity with the mounting structure, thereby maintaining continuous and uniform electrical contact between the carrier structure and the mounting structure.

16. The antenna apparatus of claim 15, wherein the fastening means is comprised of a plurality of threaded bolts seated in a first set of holes in the carrier structure, the bolts engaging a second set of holes in the mounting structure; the second set of holes being threaded and axially biased with respect to the corresponding first set of holes toward the direction of the main beam of the antenna element; whereby the carrier structure is made to apply pressure to the mounting structure in a direction transverse to the threaded bolts.

17. The antenna apparatus of claim 12, wherein the apparatus further includes a plurality of calibration elements; each calibration element being affixed equidistantly between two adjacent antenna elements.

18. The antenna apparatus of claim 17, wherein each calibration element is removably mounted directly to two adjacent carrier structures.

19. The antenna apparatus of claim 10, wherein the dielectric potting is a syntactic material.

20. A carrier structure for affixing an antenna element to a non-planar mounting structure; the carrier structure being substantially thin, rigid and electrically conductive; the carrier structure comprising:

a. a leading edge substantially flush with the mounting structure at the conjunction of the carrier structure and mounting structure;

b. an upper surface comprising:

(1) a rear portion for directly and inseparably affixing an antenna element; the rear portion of the upper surface substantially conformal to the antenna element;

(2) a forward portion having a substantially smooth surface between the leading edge of the carrier structure and the antenna element;

c. a lower surface substantially conformal to the non-planar mounting structure; and d. mounting means for removably attaching the carrier structure to the mounting structure.

21. The carrier structure of claim 20, wherein the forward portion is a surface of curvature having a substantially uniform radius between the antenna element and the leading edge of the carrier structure; the uniform radius being substantially equal to a quarter of a wavelength of a lowest frequency of interest associated with a bandwidth of interest.

22. The carrier structure of claim 21, wherein the lower surface subtends an angular subsection of a substantially conical surface conformal to the mounting structure.

23. The carrier structure of claim 22, wherein the rear portion is substantially planar; the carrier structure being directly and inseparably affixed to the antenna element.

24. The carrier structure of claim 23, wherein the upper surface further includes one or more planar facets such that each facet, together with a planar facet of an adjacent carrier structure, forms a continuous planar surface for mounting a calibration unit.

* * * * *

UNITED STATES PATENT AND TRADEMARK OFFICE

CERTIFICATE OF CORRECTION

PATENT NO. : 6,407,711 B1
APPLICATION NO. : 09/841829
DATED : June 18, 2002
INVENTOR(S) : Mark Bonebright et al.

It is certified that error appears in the above-identified patent and that said Letters Patent is hereby corrected as shown below:

On the title page:

In ITEM (57) ABSTRACT,

| | |
|---|---|
| last line, | change “array.” to --the antenna array.-- |

In the drawings:

| | |
|---|---|
| In FIG. 3, | delete reference numerals “504” and “507” appearing in the lower left-hand portion of the figure |
| In FIG. 6, | delete reference numeral “507” appearing in the lower left-hand portion of the figure |
| In FIG. 7, | delete reference numerals “702” and “708” appearing in the lower left-hand and upper right-hand portions, respectively |

UNITED STATES PATENT AND TRADEMARK OFFICE

CERTIFICATE OF CORRECTION

PATENT NO. : 6,407,711 B1
APPLICATION NO. : 09/841829
DATED : June 18, 2002
INVENTOR(S) : Mark Bonebright et al.

It is certified that error appears in the above-identified patent and that said Letters Patent is hereby corrected as shown below:

In the specification:

| | | |
|---|---|---|
| COLUMN 1, | LINES 4-8, | delete "The U.S. Government has a paid-up license in this invention and the right in limited circumstances to require the patent owner to license others on reasonable terms as provided for by the terms of contract No. N00019-94-C-0078 awarded by U.S. Department of Defense (Navy)." |
| COLUMN 4, | LINE 6, | change "antennas arrays," to --antenna arrays,-- |
| COLUMN 8, | LINE 37, | change "Thread holes **308**" to --Threaded holed **308**-- |
| COLUMN 9, | LINE 4, | change "about to the" to --about the-- |
| COLUMN 11, | L1NE 2, | change "surface **704**" to --recessed rim **704**-- |

Signed and Sealed this

Twelfth Day of August, 2008

JON W. DUDAS
*Director of the United States Patent and Trademark Office*